US008016630B2

(12) United States Patent
Lo et al.

(10) Patent No.: US 8,016,630 B2
(45) Date of Patent: Sep. 13, 2011

(54) CATHODE PLANES FOR FIELD EMISSION DEVICES

(75) Inventors: Chi-Tsung Lo, Taipei (TW); Tzung-Han Yang, Taipei (TW); Richard Allan Tuck, Slough (GB)

(73) Assignee: Tatung Company, Taipei (TW)

( * ) Notice: Subject to any disclaimer, the term of this patent is extended or adjusted under 35 U.S.C. 154(b) by 211 days.

(21) Appl. No.: 12/314,033

(22) Filed: Dec. 3, 2008

(65) Prior Publication Data

US 2009/0140629 A1 Jun. 4, 2009

(30) Foreign Application Priority Data

Dec. 3, 2007 (GB) ..... 0723603.7

(51) Int. Cl.
*H01J 17/49* (2006.01)

(52) U.S. Cl. ..... 445/24; 313/495

(58) Field of Classification Search ..... 445/24–25; 313/495–497

See application file for complete search history.

(56) References Cited

U.S. PATENT DOCUMENTS 5,461,009 A * 10/1995 Huang et al. ..... 216/11
6,004,830 A * 12/1999 Potter ..... 438/20
2007/0243493 A1 * 10/2007 Li et al. ..... 430/319

* cited by examiner

*Primary Examiner* — Anne M Hines
(74) *Attorney, Agent, or Firm* — Bacon & Thomas, PLLC

(57) ABSTRACT

A substrate 200 is provided with conductive cathode tracks and a field electron emission material on the tracks. Septa 201 and pillars 202 are provided as raised elements over the emission material. An electrically insulating layer is formed over the emission material and raised elements 201, 202, such that boundary walls are formed in the insulating layer where it contacts the raised elements. The raised elements 201, 202 are then removed, to leave emitter cells and voids for other components, defined by the boundary walls with the insulating layer. A gate electrode is provided over the insulating layer.

24 Claims, 8 Drawing Sheets

CATHODE PLANES FOR FIELD EMISSION DEVICES

This invention relates to field emission devices and cathode planes therefor, and is concerned particularly but not exclusively with methods of manufacturing addressable field electron emission cathode arrays. Preferred embodiments of the present invention aim to provide low manufacturing cost methods of fabricating multi-electrode control and focusing structures.

As will be understood by the skilled reader, a cathode plane for a field emission device will typically comprise a substrate, one or more conductive electrode on the substrate, a field electron emission material on the electrode(s), an electrically insulating layer over the emission material, and one or more gate electrode over the insulating layer. In a few applications, the gate electrode may be dispensed with. The term "cathode plane" is to be understood accordingly, in the context of this specification.

In a typical example of use in a field emission device, a cathode plane is placed in an evacuated enclosure with an anode plane, and application of a differential potential between cathode, gate, other electrodes and anode planes causes the emission of electrons from the emission material.

Preferred embodiments of the invention use broad-area field electron emission materials. However, other types of field electron emission materials may be used.

It has become clear to those skilled in the art that the key to practical field emission devices, particularly displays, lies in arrangements that permit the control of the emitted current with low voltages.

There is considerable prior art relating to tip-based emitters. The main objective of workers in the art has been to place an electrode with an aperture (the gate) less than 1 micron away from each single emitting tip, so that the required high fields can by achieved using applied potentials of 100V or less—these emitters are termed gated arrays. The first practical realisation of this was described by C A Spindt, working at Stanford Research Institute in California (*J. Appl. Phys.* 39,7, pp 3504-3505, (1968)). Spindt's arrays used molybdenum emitting tips which were produced, using a self masking technique, by vacuum evaporation of metal into cylindrical depressions in a $SiO_2$ layer on a Si substrate. Many variants and improvements on the basic Spindt technology are described in the scientific and patent literature.

A major problem with all tip-based emitting systems is their vulnerability to damage by ion bombardment, ohmic heating at high currents and the catastrophic damage produced by electrical breakdown in the device. Making large area devices is both difficult and costly. Furthermore, in order to get low control voltages, the basic emitting element, consisting of a tip and its associated gate aperture, must be approximately one micron or less in diameter. The creation of such structures requires semiconductor-type fabrication technology with its high associated cost structure. Moreover, when large areas are required, expensive equipment must be is used.

In about 1985, it was discovered that thin films of diamond could be grown on heated substrates from a hydrogen-methane atmosphere, to provide broad area field emitters.

In 1988 S Bajic and R V Latham, (*Journal of Physics D Applied Physics, vol* 21 200-204 (1988)), described a low-cost composite that created a high density of metal-insulator-metal-insulator-vacuum (MIMIV) emitting sites. The composite had conducting particles dispersed in an epoxy resin. The coating was applied to the surface by standard spin coating techniques.

Much later (1995) Tuck, Taylor and Latham (GB 2 304 989) improved the above MIMIV emitter by replacing the epoxy resin with an inorganic insulator that both improved stability and enabled it to be operated in sealed off vacuum devices.

At the present time, field emitting arrays utilising carbon nanotubes (CNT) as the emitter have become very fashionable.

The best examples of such broad-area emitters can produce usable electric currents at fields less than 10 $V\mu m^{-1}$. In the context of this specification, a broad-area field electron emission material is any material that by virtue of its composition, micro-structure, work function or other property emits useable electronic currents at macroscopic electrical fields that might be reasonably generated at a planar or near-planar surface—that is, without the use of atomically sharp fabricated micro-tips as emitting sites. Surfaces coated with CNTs are included with this definition.

In 1997, one of the Inventors described a low-cost method of manufacturing field emitting arrays for displays and similar devices (GB 2,330,687); this is explained here with reference to FIG. 1 of the accompanying diagrammatic drawings and its contents are incorporated herein by reference. In this document, the Applicants describe a self-aligning process using differential etches to form emitter cells 105 and expose an emitter layer 102. Experience has shown that optimal via dimensions are 10 to 20 micrometres in diameter with a 3 to 4 microns thick dielectric layer 103. The pixels are addressed via cathode (column) tracks 101 on substrate 100 and orthogonal gate tracks 104.

Although this invention offered many advantages over the then previous art, experience has shown that the best form of etching to produce close-packed groups of vias of the desired dimensions is reactive ion etching, as this avoids often uncontrolled undercutting of the gate electrode and produces vias with vertical walls. However, reactive ion etch becomes an expensive operation as one moves to large size displays.

Consequently, the present inventors have sought an alternative way to fabricate field emission arrays with desired via size and geometry, without the use of anisotropic reactive ion etching. In an embodiment of the present invention, a negative mould of sacrificial material is used to define a via and track structure within a device, into which various functional layers of a gated structure are deposited—see, for example, FIG. 2 of the accompanying diagrammatic drawings, wherein 200 is a usual glass substrate; and components 201 and 202 form a negative (male) mould of emitter cell vias and inter-gate-track areas.

According to one aspect of the present invention there is provided a method of creating a cathode plane for a field emission device, the method comprising the steps of:

a. providing a substrate, at least one electrically conductive electrode on the substrate and a field electron emission material on the or each said electrode;
b. providing over said emission material a plurality of raised elements;
c. forming an electrically insulating layer over said emission material and raised elements, such that boundary walls are formed in said insulating layer where it contacts said raised elements; and
d. removing said raised elements to leave emitter cells defined by said boundary walls.

Preferably, a gate electrode is provided over said insulating layer

Said gate electrode may be provided either before or after said raised elements are removed.

Preferably, said gate electrode is applied by a process selected from the group comprising sputtering, electroless plating and printing.

A focus electrode may be applied to the cathode plane by a process selected from the group comprising sputtering, electroless plating and printing.

Preferably, at least some of said raised elements are elongate to form upright pillars over said emission material.

Preferably, further raised elements are provided and subsequently removed to define voids for other components of the cathode plane.

Preferably, said raised elements are removed by a process selected from the group comprising immersion in a solvent; attachment to an adhesive film that is then removed; depolymerising by heating; oxidisation by heating in a suitable atmosphere; and a plasma process.

A protective layer may be provided over said emission material to protect it from subsequent steps of the method.

Said protective layer may comprise aluminium.

Preferably, at least part of said protective layer is removed by an etching process to expose at least part of said emission material after removing said raised elements to leave emitter cells defined by said boundary walls.

Preferably, said raised elements are of photoresist.

The invention extends to a cathode plane created by a method according to any of the preceding aspects of the invention.

The invention extends to a field emission device comprising such a cathode plane, and means for applying an electric field to said field electron emission material, thereby to cause said material to emit electrons.

The raised elements may be formed of a photoresist layer including a photosensitised polynorbornene (PNB) formulated so as to produce sufficiently thick layers, as discussed below.

The substrate may be pre-prepared with said at least one electrically conductive electrode and said field electron emission material on it, as a preliminary step of the method.

The raised elements may be formed from a coating applied by any convenient means known in the art, including but not limited to: spinning, screen-printing, bar-coating, table coating, blade coating, and meniscus coating.

Preferably, such a coating is deposited such that the dry thickness of the deposit is greater than the final thickness of the gate electrode and insulating layer, including allowances for wet thicknesses of inks prior to drying and curing.

Preferably, said dry thickness is at least 20% greater than the final thickness of the gate electrode and insulator, including allowances for wet thicknesses of inks prior to drying and curing.

After deposition, said coating is carefully dried to remove the solvent.

Preferably, said coating is photo-patternable by exposure to ultraviolet light or other radiation.

If said coating is a photo-patternable formulation then, following coating and drying, the layer is exposed through a suitable mask to define the areas of the surface where the raised elements are to be retained.

If said coating is a PNB (polynorbornene), this causes the polymer to cross-link and to be solvent resistant in areas where it has been exposed.

After said coating is exposed, the material may be heat-treated to ensure adequate cross-linking occurs.

Said exposed pattern may be developed by dissolving the unexposed areas using any suitable solvent.

The photoresist may then be exposed through a suitable mask to define an array of pillars and septa and protective material patterned by etching, so as to expose the raised elements to be removed. The pattern may then be developed by any suitable solvent or etching means.

Areas where the raised elements have been removed may be further cleaned to remove any residual traces of the material of the elements. This may be accomplished using any suitable means, e.g. solvent washing or reactive ion cleaning.

The material of the raised elements may have its surface properties modified to control wetting by application of a chemical layer or treatment or chemical or reactive ion treatment.

The electrically insulating (or dielectric) layer may be deposited using an ink containing a dielectric precursor with or without suitable nanoscale fillers. Examples of suitable inks are described in the applicant's prior publication GB 2 395 922. However, the present invention is not limited to using such inks.

Such a layer may be deposited in a single stage or in multiple applications, with suitable drying steps in between. The dielectric coating layers may have different electrical properties—e.g. different dielectric constants or resistivity.

The ink may be applied using any suitable means—e.g. spinning, screen-printing. Such techniques do not have the resolution to print the microstructures necessary for field emitter devices directly. Such microstructures are formed under the influence of gravity and surface tensional forces, as the applied dielectric-forming-inks settle into the necessary microstructure positions defined by the surfaces of the raised elements.

If the dielectric-forming-ink is water-based, then the material of the raised elements will preferably be inherently hydrophobic or its surface treated to render it hydrophobic.

If the dielectric-forming-ink is organic-solvent-based, then the material of the raised elements will preferably be inherently hydrophilic or its surface treated to render it hydrophilic.

The settling of the dielectric-forming-inks into the necessary microstructure positions may be assisted by the application of vibration to the substrate.

A layer of conductive material may be applied to the surface of the insulating (dielectric) layer to form the gate electrode.

Preferably, such a conducting layer may be deposited by sputtering, or vacuum evaporating or electroless plating a suitable coating onto the dielectric surface, immediately after the dielectric deposition. The device is then fired in vacuum or a high-purity nitrogen atmosphere. This has the effect of densifying the dielectric further and can volatilise the sacrificial material in the channels. Residual unattached particles of metallisation that had been deposited on top of the sacrificial layer may be removed by a lift-off process.

Such conductive material may be deposited after removal of the raised elements, by printing a conducting layer from an ink whose rheology is selected so that it does not penetrate into the emitter cell vias.

Alternatively, a conductive layer may be formed by applying a metallising ink whilst the raised elements are still present. The wetting properties of the material of the raised elements ensure that the emitter cells receive minimal coating. Subsequent furnacing may volatilise the sacrificial layer and convert the ink into a conductive metallic coating.

The conductor for the gate electrode may be formed by electroless plating by applying aqueous solutions of precursor materials (e.g. Sn(II) compounds, and/or palladium compounds) to the surface of deposited material of the raised elements and/or dielectric before furnacing, and then electrolessly depositing a metallisation layer e.g. of nickel once the raised elements have been removed.

Such precursor materials may be applied as a thin layer using a suitable coating method, so that reticulation from a hydrophobic layer of material of the raised elements surfaces minimises the uptake of precursor materials onto the surfaces of that material.

Preferably, such an electroless plating process is an immersion process.

Preferably, any metallisation left over from areas on top of the sacrificial material (of the raised elements) are removed by mechanical polishing procedures such as, for example, abrasives or chemical mechanical planarisation (CMP), known in the art, which only contact high spots remaining on the surface where the sacrificial material used to be.

For a better understanding of the invention, and to show how embodiments of the same may be carried into effect, reference will now be made, by way of example, to the accompanying diagrammatic drawings, in which.

Figure 1:
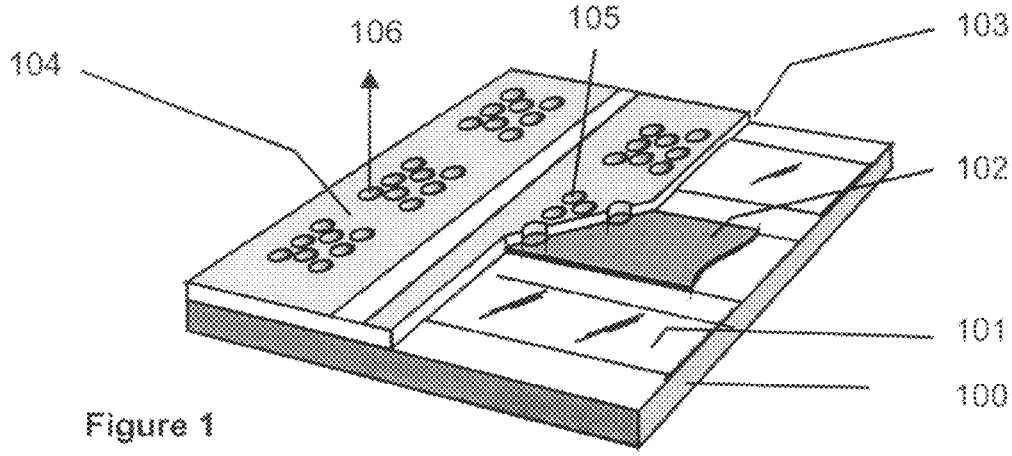
Figure 1 Prior Art
FIG. 1 illustrates a known field emission display.
Figure 2:
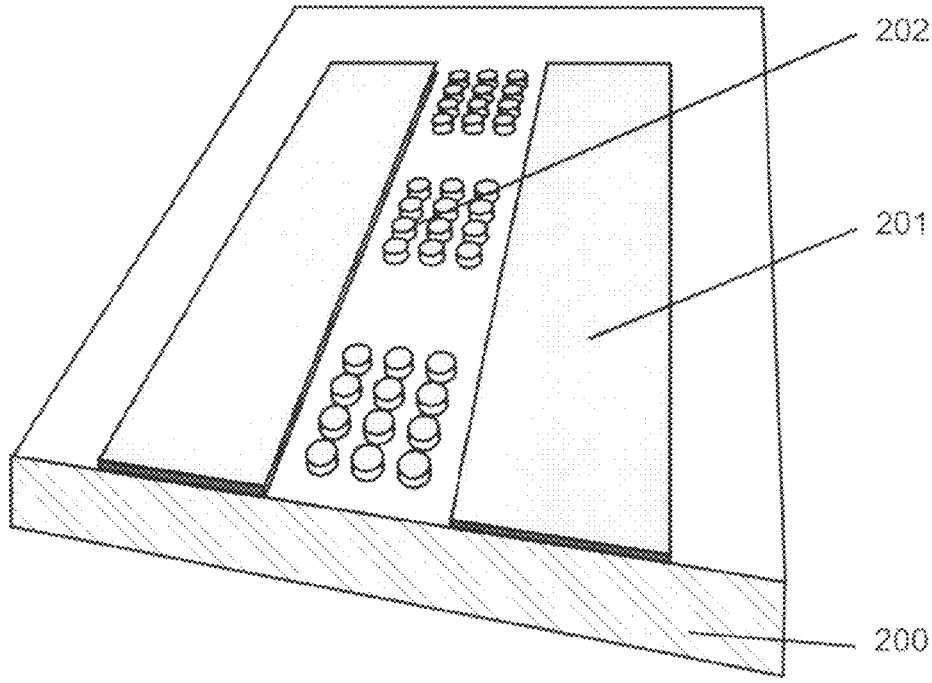
FIG. 2 illustrates how photoresist may be used to create a negative mould in which pillars and septa may be used to form vias and inter-track spaces.
Figure 3:
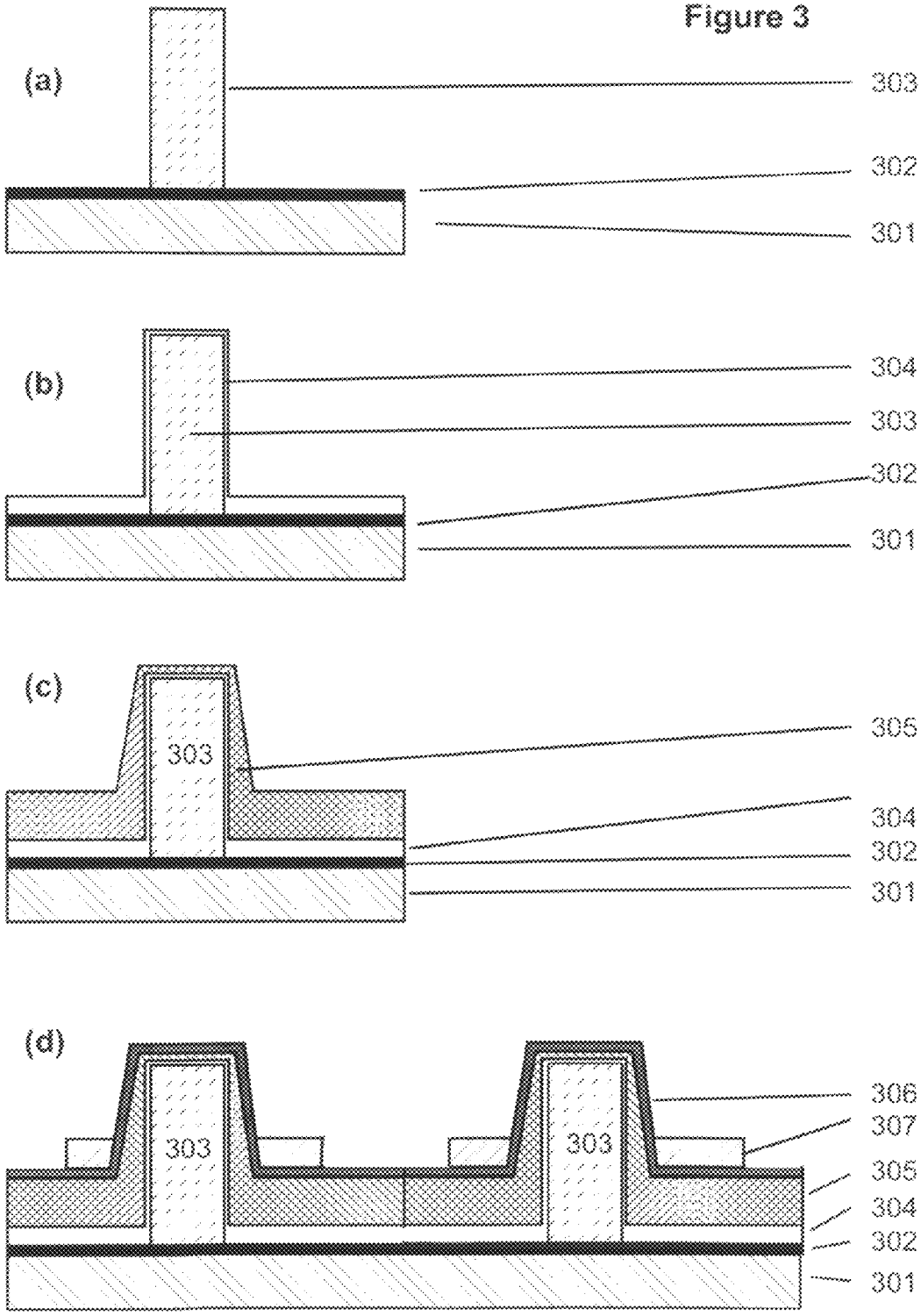
Figure 3:
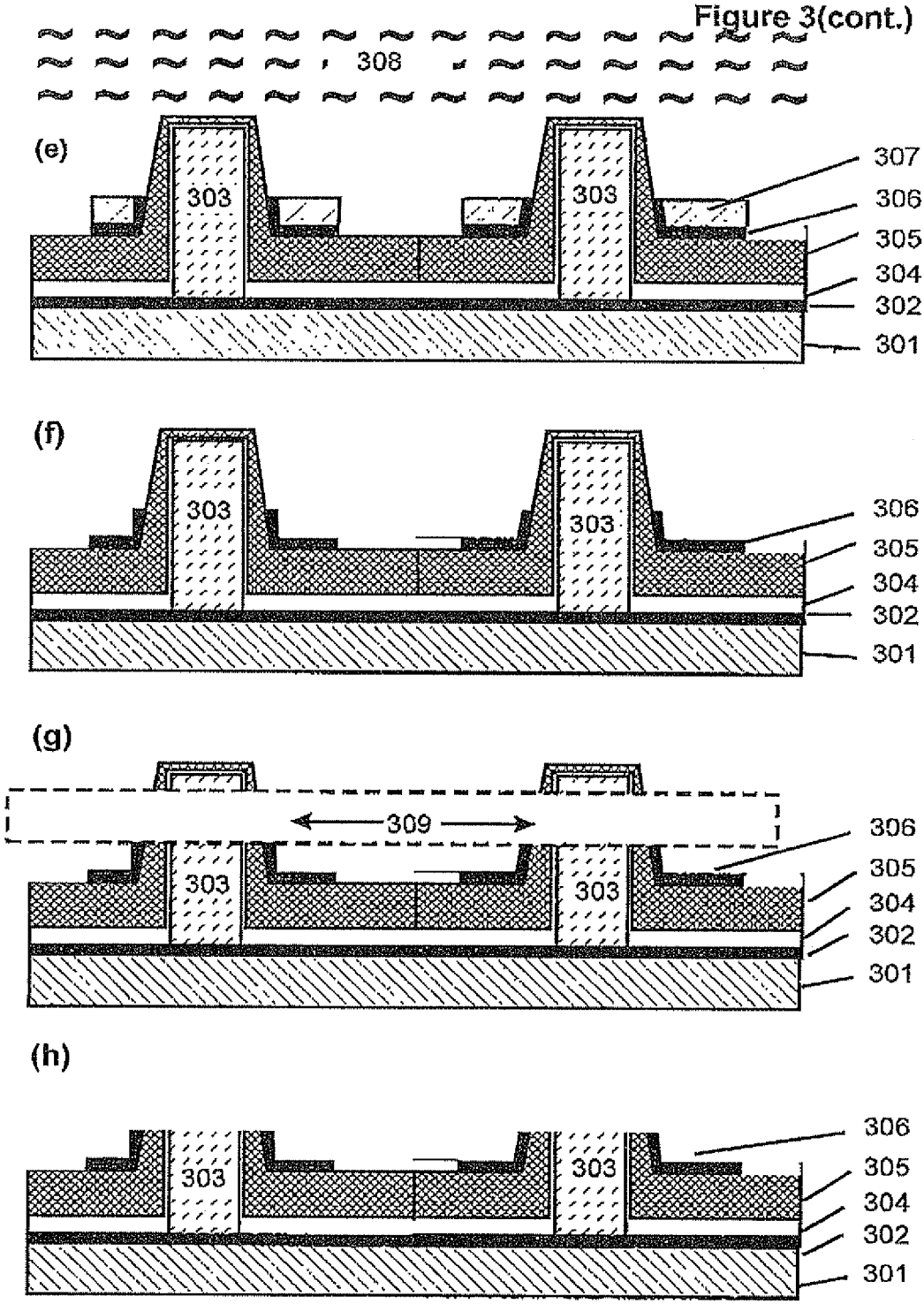
Figure 3:
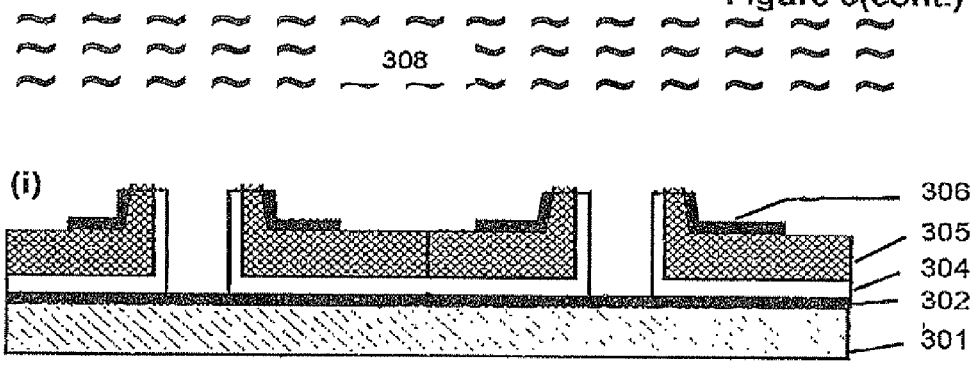
Figure 4:
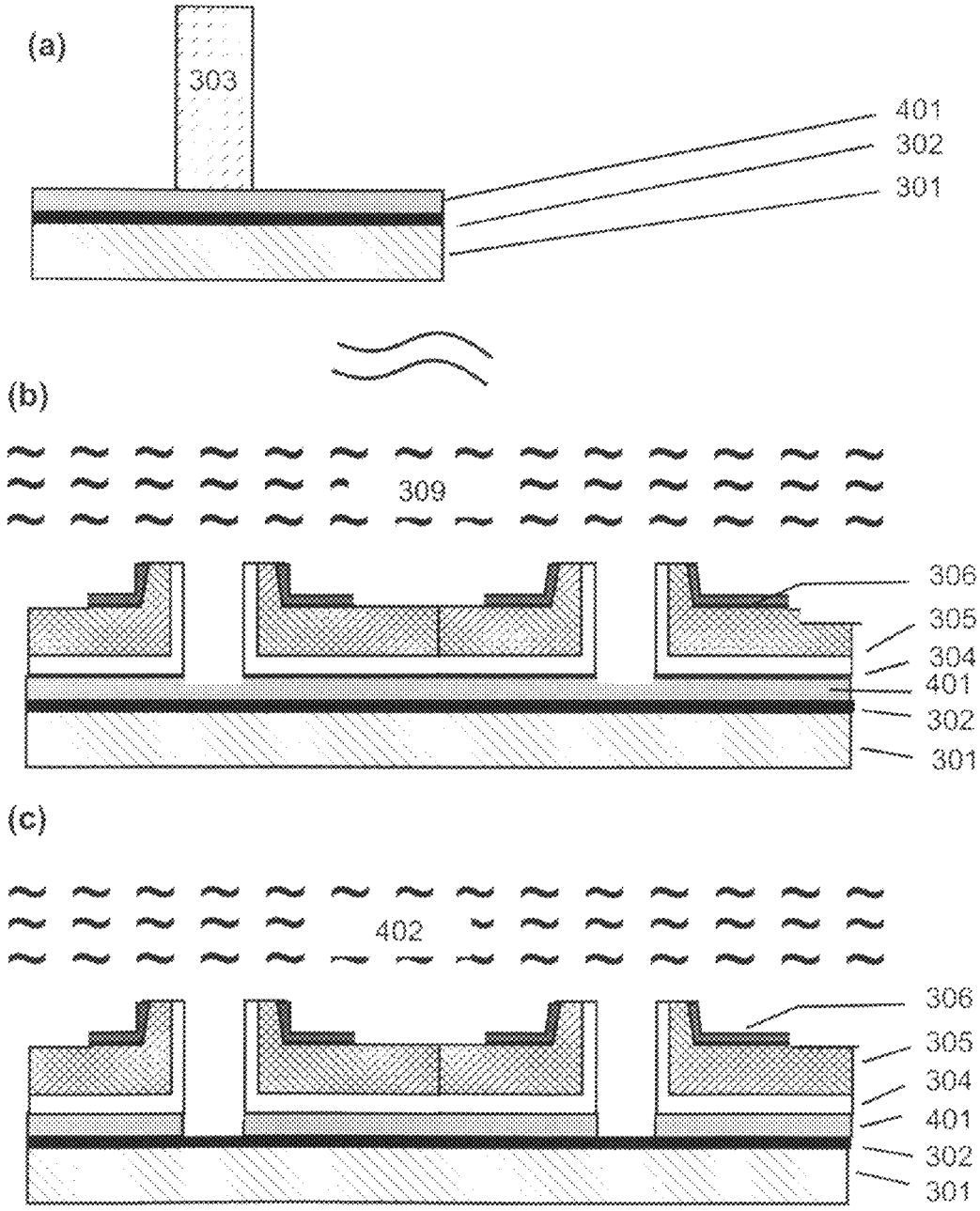
Figure 5:
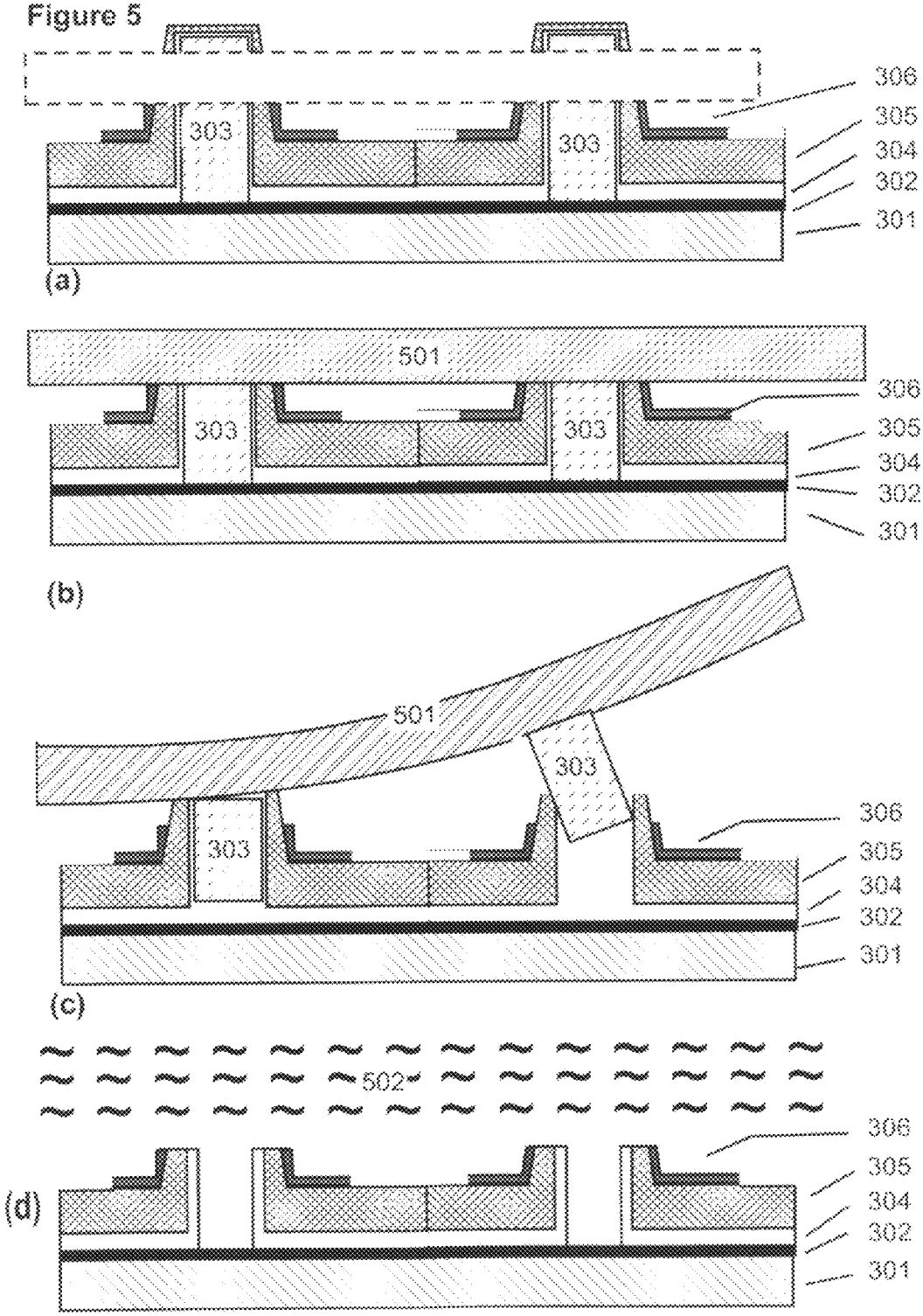
Figure 6:
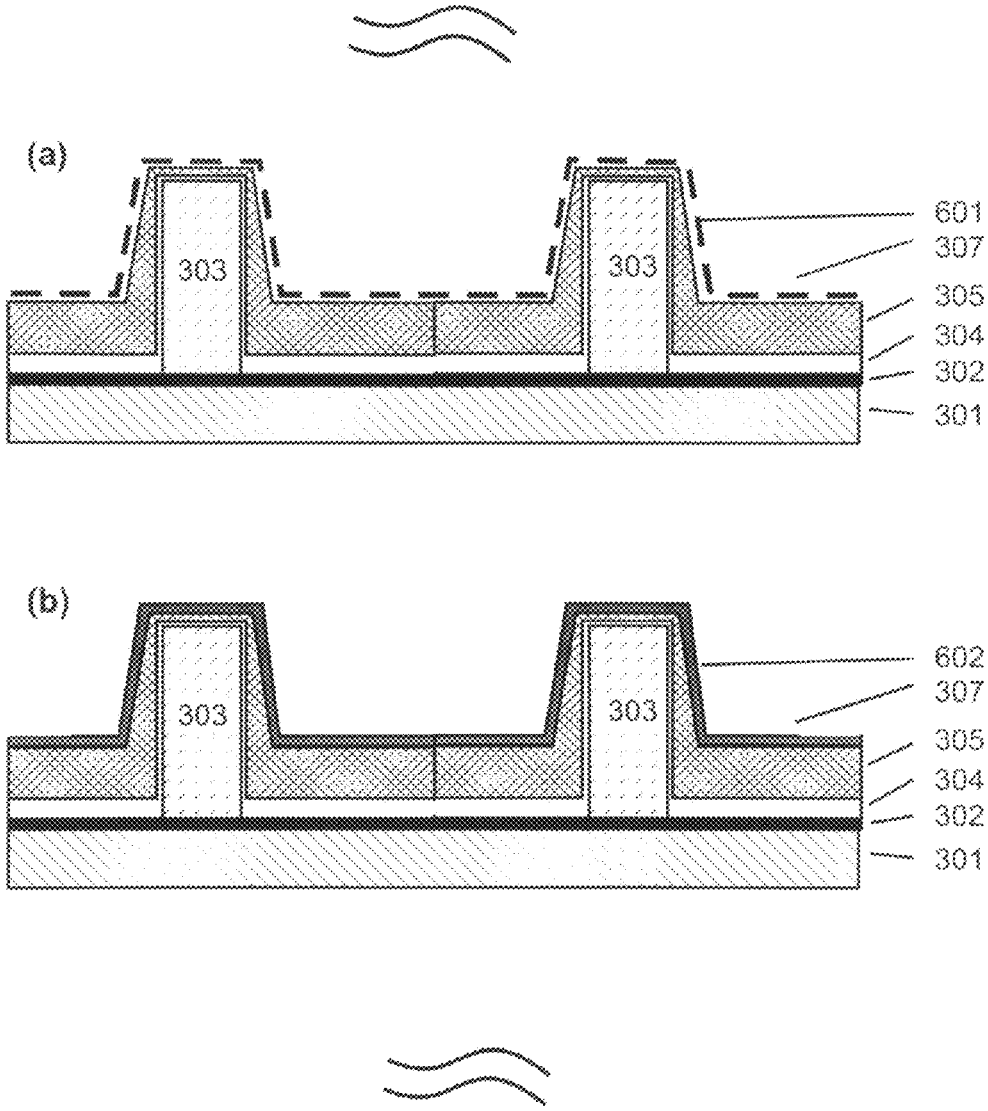

FIGS. 3(*a*) to 3(*i*) illustrate a series of steps in one example of a process flow according to one embodiment of the invention;

FIGS. 4(*a*) to 4(*c*) illustrate steps of an alternative process flow, using a barrier layer to protect an emitter from process chemicals;

FIGS. 5(*a*) to 5(*d*) illustrate an alternative means of removing photoresist pillars with adhesive tape;

FIGS. 6(*a*) and 6(*b*) illustrate how gate metal may be deposited by electroless plating rather than sputter coating; and FIGS. 7(*a*) and 7(*b*) illustrate examples of devices that may be made using techniques as disclosed herein.

In the figures, like references denote like or corresponding parts.

For ease of illustration and understanding, the following embodiments of the invention are described in terms of a monochrome display. However, the skilled reader will understand how, with (for example) three columns per pixel, a pixelated phosphor and suitable driving means, other embodiments may readily form a colour display.

Throughout the specification, reference is made to photolithography and, except where special materials or techniques are described, this means photolithography as a normal person skilled in the art would understand it. For example, a substrate is covered with a photosensitive material called a photoresist. This is usually performed by spin-coating; the layer is soft-baked around 100° C. to drive off excess solvent. The substrate is then exposed to ultraviolet light through a mask to define a pattern. The pattern is then developed and then re-baked at a higher temperature. The substrate, or more likely a thin film on it, is then etched away using a suitable reagent, to produce the desired pattern. Finally the photoresist mask is removed with a stripper chemical.

EXAMPLE 1

FIG. 3*a* shows the first stage of a process to create a field emitter, with an insulating substrate (usually glass) 301 and an emitter layer including an associated electrically conductive track 302. Following standard photo-lithographic steps that will be known to a person skilled in the art, an array of pillars 303 are provided. For simplicity, the process is described at the emitter cell level. A photoresist pillar 303 sits atop a broad area emitter layer 302 already formed into tracks to make up columns of a display. The pillar 303 will later form an emitter cell via. Suitable emitter materials would include those described by Tuck et al in GB 2 304 989, GB 2 332 089, GB 2 367 186, and Burden et al in GB 3 379 079, but the scope of the invention is not limited to these types of emitter.

FIG. 3*b* shows the structure coated with a layer 304 of sputtered insulator, typically silica ~1 micron thick, to provide a defect free insulating layer.

FIG. 3*c* shows how a layer 305 of a silica-based spin-on-glass is applied to complete what will eventually become a gate insulator or dielectric. Said layer 305 is typically applied in multiple layers to avoid cracking. It is partially heat treated to the maximum temperature that the photoresist will tolerate (e.g. ~160° C.) without becoming totally cured.

FIG. 3*d* shows the next two stages of the process in which a sputtered layer of gate metal 306, typically gold with a chromium adhesion layer, is applied; and then gate track regions 307 are defined using a photoresist and photo-patterning methods known to those skilled in the art.

FIG. 3*e* shows gate metal 306 with unwanted portions etched away from unwanted areas to define both an emitter cell and spaces between gate tracks. The skilled reader will understand that, for clarity, only one emitter cell per pixel is illustrated whereas, in reality, there are several hundred emitter cells per pixel. In the case of a gold—chromium layer, typical etches 308 will be iodine plus potassium iodide and cerric ammonium nitrate respectively.

FIG. 3*f* shows the structure after etching the gate metal 306 and stripping of photoresist.

FIG. 3*g* shows the next stage of the process. In order to expose the photoresist pillar 303 and to create a macroscopically planar surface, an abrasion and polishing step 308 is used. The process 309 starts with course abrasive paper ending with much finer media; such processes will be known to the skilled reader. The result of this process is illustrated in FIG. 3*h*.

FIG. 3*i* shows a penultimate stage where the substrate is immersed in an aggressive resist stripper 308. The substrate is then thoroughly rinsed and dried.

Finally, the substrate is heat treated to 450° C. to 500° C. to complete the sintering of the spin-on glass.

The end result of this process is a cathode plane ready to be sealed into a display, evacuated, baked out and sealed off in a manner known to persons skilled in the art.

In the above and in other Examples, the photoresist used to form the pillars or other raised elements must tolerate heating in air to at least 160° C. i.e. the temperature used to part-cure the precursor inks used to form the gate insulator. After such heating, the photoresist must be capable of complete removal by such means as immersion in a suitable solvent, pulled out by stripping off an adhesive film, depolymerising by means of heat, oxidisation by heating in a suitable atmosphere or plasma process. Furthermore, it must form resist layers thick enough to stand proud of the wet thickness of the precursor inks ~10 micron and, after exposure and development, form raised elements with strength and adequate aspect ratios.

The stripping process is important and we have found that, for a solvent immersion method, heated aggressive strippers as used to remove fluorocarbon residues that form on the side walls of vias formed by fluorine chemistry reactive ion etch are also suitable for this purpose.

EXAMPLE 2

FIGS. 4*a* to 4*c* illustrate another embodiment of the present invention. FIG. 4*a* shows an extra protective layer 401 approximately 1 micron in thickness, to protect the emitter 302 from the effects of the resist stripper. It is formed into column tracks at this stage by standard photolithography. One suitable material for the layer 401 is aluminium. The process then proceeds in the same way as Example 1, until the state shown in FIG. 4*b*, which is equivalent to FIG. 3*i*.

After rinsing and heat treatment, the protective layer 401 is removed with a suitable etch 402, as shown in FIG. 4*c*. For a layer 401 of aluminium, one suitable etch 402 is dilute hydrochloric acid.

The substrate 301 is rinsed and dried and the end result of this process is a cathode plane ready to be sealed into a display, evacuated, baked out and sealed off in a manner known to persons skilled in the art.

EXAMPLE 3

FIGS. 5*a* to 5*c* illustrate an alternative means of removing photoresist pillars. FIG. 5*a* represents the stage of the process after a polishing process 309 as in FIG. 3*g*.

A hardenable polyurethane coating 501 is then applied onto the tops of the pillars 303 as shown in FIG. 5*b*. The coating is rolled to ensure good contact. On drying, the coating forms an adhesive tape which can be peeled off the substrate 301, together with the pillars 303, as shown in FIG. 5*c*. Any pillar residue is flushed out with a suitable stripper, as shown in FIG. 5*d*.

EXAMPLE 4

An alternative method of depositing gate metal is electroless plating, as illustrated in FIGS. 6*a* and 6*b*.

The processing of the substrate is identical up to the sputter coating shown in Example 1, FIG. 3*d* and then proceeds in an alternative way.

FIG. 6*a* shows an activation layer 601 on the surface of insulator or dielectric 305.

The activation layer 601 is formed by rinsing the substrate in a pre-dip to avoid contamination of an activator bath. It is then immersed in the activator bath containing a tin-palladium colloid activator, followed by rinsing and drying. It is next dipped in an accelerator solution containing fluoroboric acid, followed by rinsing and drying.

The substrate is then transferred to a proprietary electroless nickel plating bath containing soluble nickel salts and reducing agents, where a nickel layer 602 is formed.

A photoresist layer is then applied and the process then continues from the second part of Example 1, FIG. 3*d*.

EXAMPLE 5

An alternative to the photoresist is to form the pillars 303 from photo-sensitised polynorbornene. For example, a solution of 5-butyl norbornene and 5-alkenyl norbornene in mesitylene with 4% dry weight of initiator (e.g. Irgacure 819, Ciba Speciality Chemicals) is screen-printed onto a pre-formed cathode plane, so as to produce an appropriate dry film thickness.

This coating is exposed to UV radiation (365 nm) via a photolithographic mask. After exposure, the coating is baked in a vacuum (or high purity nitrogen) oven for 30 minutes at 120° C.

The pattern is then developed using xylene, to remove unexposed areas, forming a structure as in FIG. 3*a*.

Processing then proceeds as before until FIG. 3*g*.

The assembly is then heated to 450° C. in, preferably, a vacuum oven or alternatively a high purity nitrogen oven, at a ramp rate of 8° C./minute and held at this temperature for 2 hours to volatilise the PNB. Subsequently the device is given another 2-hour furnace treatment, this time in air to fully densify the insulator layer 305.

EXAMPLE 6

An alternative to spin-on-glass 305 is to use a silica ink as described in GB 2,395,922, which may be deposited using a formulation containing a dielectric precursor with suitable nanoscale fillers.

The ink may be deposited in a single stage or in multiple applications, with suitable drying steps in between. The dielectric coating layers may have different electrical properties—e.g. different dielectric constants or resistivity.

The ink may be applied using any suitable means—for example, screen-printing.

In the above examples, the pillars are of substantially circular cross-section. They may have any other desired cross-sectional shape. Other raised elements of photoresist may be provided and utilised in a similar manner to the pillars 202 and septa 201 for other elements of a cathode plane such as, for example, a focus electrode layer.

In the foregoing, only one or two emitter cells have been shown and described, in the interests of clarity and for ease of understanding. However, in a practical cathode plane, there will typically be millions of emitters cells, of a typical diameter in the range 0.5 to 50 micrometres and with a cell-to-cell spacing in the range 1 to 100 micrometres. For example, with a tiny display of 32×32 pixels and 250 cells per pixel, the total number of cells would be 256,000. For a very small display of 100×100 pixels and 250 cells per pixel, the total number of cells would be 2,500,000. A large high-definition display might contain 1000×3000 pixels at 250 cells per pixel=750 million. In preferred embodiments of the invention, a pixel will contain at least 50 emitter cells, and preferably at least 250 emitter cells or at least 500 emitter cells.

Examples of devices embodying field electron emitters as described above are illustrated in FIGS. 7*a* and 7*b*.

Figure 7A:
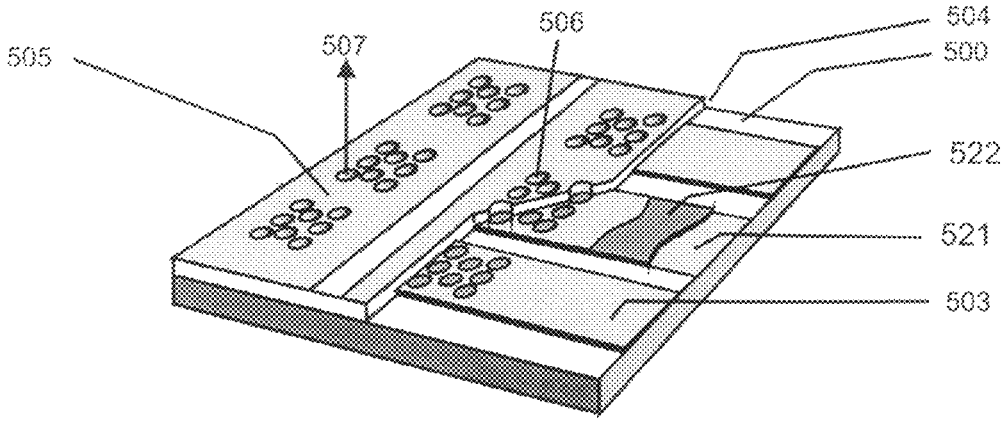

FIG. 7*a* shows an addressable gated cathode as might be used in a field emission display. The structure is formed of an insulating substrate 500, cathode tracks 521, emitter layer 522, focus grid layer 503 electrically connected to the cathode tracks, gate insulator 504, and gate tracks 505. The gate tracks and gate insulators are perforated with emitter cells 506. A negative bias on a selected cathode track and an associated positive bias on a gate track causes electrons 507 to be emitted towards an anode (not shown).

The reader is directed to patent GB 2 330 687 for further details of constructing Field Effect Devices.

The electrode tracks in each layer may be merged to form a controllable but non-addressable electron source that would find application in numerous devices such as lamps.

Figure 7B:
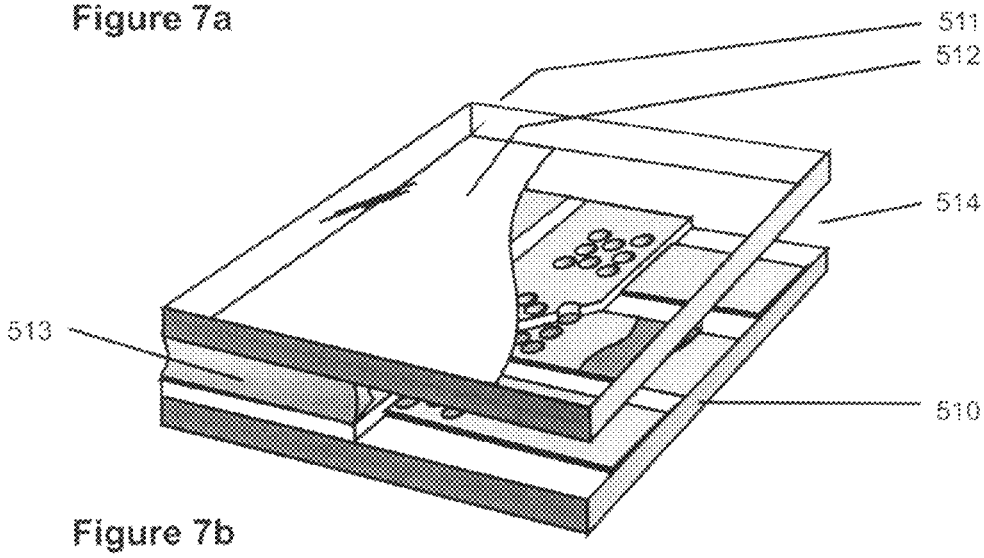

FIG. 7*b* shows how the addressable structure 510 described above may be joined with a glass fritt seal 513 to a transparent anode plate 511 having upon it a phosphor screen 512. The space 514 between the plates is evacuated, to form a display.

In this specification, the verb "comprise" has its normal dictionary meaning, to denote non-exclusive inclusion. That is, use of the word "comprise" (or any of its derivatives) to include one feature or more, does not exclude the possibility of also including further features.

The reader's attention is directed to all and any priority documents identified in connection with this application and to all and any papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method of creating a cathode plane for a field emission device, the method comprising the steps of:

a. providing a substrate, at least one electrically conductive electrode on the substrate and a field electron emission material on each said electrode;

b. providing over said emission material a plurality of raised elements;

c. forming an electrically insulating layer over said emission material and raised elements, such that boundary walls are formed in said insulating layer where it contacts said raised elements;

d. removing said raised elements to leave emitter cells defined by said boundary walls, and wherein a protective aluminum layer is provided over said emission material to protect it from subsequent steps of the method.

2. The method according to claim 1, further comprising a gate electrode over said insulating layer.

3. The method according to claim 2, wherein said gate electrode is provided before said raised elements are removed.

4. The method according to claim 2, wherein said gate electrode is provided after said raised elements are removed.

5. The method according to claim 2, wherein said gate electrode is applied by a process selected from the group comprising sputtering, electroless plating and printing.

6. The method according to claim 1, wherein a focus electrode is applied to the cathode plane by a process selected from the group comprising sputtering, electroless plating and printing.

7. The method according to claim 1, wherein at least some of said raised elements are elongate to form upright pillars over said emission material.

8. The method according to claim 1, wherein further raised elements are provided and subsequently removed to define voids for other components of the cathode plane.

9. The method according to claim 1, wherein said raised elements are removed by a process selected from the group comprising immersion in a solvent; attachment to an adhesive film that is then removed; depolymerising by heating; oxidisation by heating in a suitable atmosphere; and a plasma process.

10. The method according to claim 1, wherein at least part of said protective layer is removed by an etching process to expose at least part of said emission material after removing said raised elements to leave emitter cells defined by said boundary walls.

11. The method according to claim 1, wherein said raised elements are of photoresist.

12. A cathode plane created by a method according to claim 1.

13. A field emission device comprising a cathode plane according to claim 12 and means for applying an electric field to said field emission material, thereby to cause said material to emit electrons.

14. A method of creating a cathode plane for a field emission device, the method comprising the steps of:

a. providing a substrate, at least one electrically conductive electrode on the substrate and a field electron emission material on each said electrode;

b. providing over said emission material a plurality of raised elements;

c. forming an electrically insulating layer over said emission material and raised elements, such that boundary walls are formed in said insulating layer where it contacts said raised elements;

d. removing said raised elements to leave emitter cells defined by said boundary walls, and wherein a protective layer is provided over said emission material to protect it from subsequent steps of the method and wherein at least part of said protective layer is removed by an etching process to expose at least part of said emission material after removing said raised elements to leave emitter cells defined by said boundary walls.

15. The method according to claim 14, further comprising a gate electrode over said insulating layer.

16. The method according to claim 15, wherein said gate electrode is provided before said raised elements are removed.

17. The method according to claim 15, wherein said gate electrode is provided after said raised elements are removed.

18. The method according to claim 15, wherein said gate electrode is applied by a process selected from the group comprising sputtering, electroless plating and printing.

19. The method according to claim 14, wherein a focus electrode is applied to the cathode plane by a process selected from the group comprising sputtering, electroless plating and printing.

20. The method according to claim 14, wherein at least some of said raised elements are elongate to form upright pillars over said emission material.

21. The method according to claim 14, wherein further raised elements are provided and subsequently removed to define voids for other components of the cathode plane.

22. The method according to claim 14, wherein said raised elements are removed by a process selected from the group comprising immersion in a solvent; attachment to an adhesive film that is then removed; depolymerising by heating; oxidisation by heating in a suitable atmosphere; and a plasma process.

23. The method according to claim 14, wherein at least part of said protective layer is removed by an etching process to expose at least part of said emission material after removing said raised elements to leave emitter cells defined by said boundary walls.

24. The method according to claim 14, wherein said raised elements are of photoresist.

* * * * *